United States Patent [19]

Watts

[11] 4,117,748

[45] Oct. 3, 1978

[54] KNIFE SCABBARD AND SHARPENING DEVICE

[75] Inventor: Keith Ernest Watts, Brunswick, Australia

[73] Assignee: Wiltshire Cutlery Company Proprietary Limited, South Melbourne, Australia

[21] Appl. No.: 812,693

[22] Filed: Jul. 5, 1977

[30] Foreign Application Priority Data

Jul. 28, 1976 [AU] Australia ..... 6786/76

[51] Int. Cl.[2] ..... B21K 11/02

[52] U.S. Cl. ..... 76/86

[58] Field of Search ..... 76/82, 86, 88; 30/138; 51/204, 205 WG, 214, 211 R

[56] References Cited

U.S. PATENT DOCUMENTS

| | | | |
|---|---|---|---|
| 2,765,680 | 10/1956 | Murchison | 76/86 |
| 2,893,178 | 7/1959 | O'Riordan | 51/214 |
| 3,774,350 | 11/1973 | Bayly | 51/214 |

*Primary Examiner*—Harold D. Whitehead
*Assistant Examiner*—Roscoe V. Parker
*Attorney, Agent, or Firm*—Charles E. Brown

[57] ABSTRACT

A sharpening device for knife scabbards, having a support block and two sharpening plates secured thereto. The plates project beyond an upper side of the support block so that respective broad surfaces of the two plates are in opposed and overlapping relationship, and the adjacent edges of the plates which extend beyond the zone of the overlap are relatively arranged to define a sharpening recess between them. The opposed broad surfaces are spaced apart so that a gap exists between the two plates, and the broad surfaces of both plates are polished, preferably to 0.4 micro meters Ra value.

5 Claims, 6 Drawing Figures

KNIFE SCABBARD AND SHARPENING DEVICE

This invention relates to knife sharpening devices of the kind in which a pair of overlapping plates are arranged to define a sharpening recess between them, and the sharpening operation is carried out by drawing the knife blade through that recess while the blade cutting edge is maintained in engagement with the plates. Edges of the plates form sharpening edges and function to sharpen the blade cutting edge by abrading or shaving the blade surfaces defining that cutting edge. Such sharpening devices are disclosed in Australian Pat. Nos. 424,122 and 447,537.

Sharpening devices of the kind indicated suffer a disadvantages in that they tend to become clogged with debris, and the accumulation of that debris can render the device completely ineffective for sharpening purposes. That problem arises especially when the device used in kitchens and other environments in which it is subjected to fatty deposits which facilitate the collection of debris on surfaces and in crevices around the sharpening edges of the sharpener plates.

A further problem encountered with such devices is that a very small part of each plate engages the knife blade during sharpening operations, so that wear takes place fairly rapidly and the effectiveness of the device deteriorates accordingly. In scabbard mountings as disclosed by the aforementioned Australian patents, the sharpener device pivots during each sharpening operation, but in spite of that movement the point of contact between the knife blade and the sharpener plates remains substantially the same. If the cutting edge of the knife blade is profiled, there will be a change in the approach angle of the cutting edge relative to the sharpener plates during a sharpening operation, but that will cause only a small change in the aforementioned point of contact.

It is a principal object of the present invention to provide a sharpening device of the kind indicated which is so constructed that the problems discussed above are overcome or at least minimized.

A feature of the device according to the invention is that the sharpener plates are not in face to face engagement, but a space exists between their adjacent overlapping surfaces. The width of that space can vary according to requirements, but by way of example it may be substantially equal to the thickness of one of the sharpener plates. It has been found that two advantages arise from that spacing of the plates.

Firstly, the space between the plates provides escape for debris so that accumulation around the sharpening edges is substantially checked. In particular, metal particles resulting from the sharpening operations are not able to accumulate at the interface of the two sharpener plates, with the same degree of ease as in prior constructions. Secondly, the spacing of the plates causes a change in the point of contact between the knife blade and the plates during movement of the blade through the sharpening recess. That is, contact with the blade occurs over a length of each sharpening edge as the approach angle of the blade is varied, and as a result wear is distributed over a greater part of each plate and the effective life of the advice is significantly extended.

It is to be understood that the aforementioned approach angle is the angle subtended between the plane of a plate sharpening edge and the cutting edge of the knife blade at the zone of engagement with that sharpening edge. The sharpening edge plane is in effect the plane of the broad surface of the plate defining that edge.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

Figure 1:
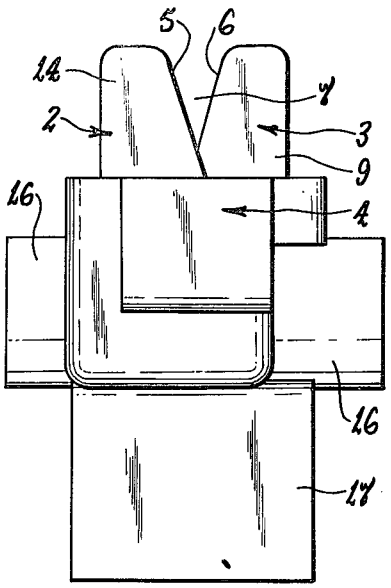
FIG. 1 is a front elevational view of an example sharpening device incorporating the present invention.

In the example construction shown, the two plates 2 and 3 are secured to a pivotable support block 4, but other arrangements can be employed. Side edges 5 and 6 of the plates 2 and 3 respectively, extend beyond the zone of overlap between the two plates so as to define a sharpening recess 7 between them. The depth of that recess 7 and the angular relationship of the edges 5 and 6, will be selected according to requirements, and consequently need not be as shown in FIG. 1.

Figure 2:
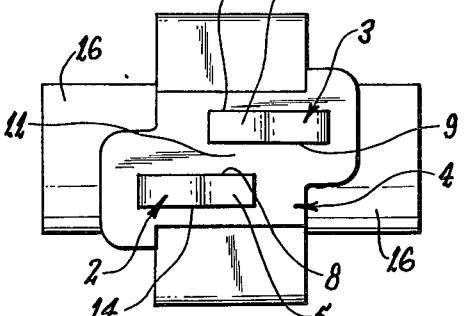
FIG. 2 is a plan view of the device shown in FIG. 1.

As best seen in FIG. 2, the opposed surfaces 8 and 9 of the plates 2 and 3 respectively are spaced apart so that a gap 11 is formed between them. The width of the gap 11 as shown, is substantially the same as the width of each plate 2 and 3, but that is not essential. It should also be understood that the gap 11 need not exist over the entire exposed portions of the plates 2 and 3, but need only exist along the edges 5 and 6 and an immediately adjacent part of the zone of overlap between the plates 2 and 3.

Figure 4:
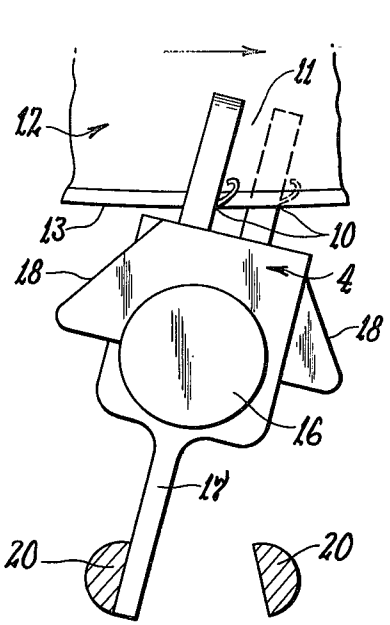
FIGS. 3 and 4 show the device in side elevation and being engaged by a knife blade, the direction of movement of the knife blade being different in each case.
Figure 3:
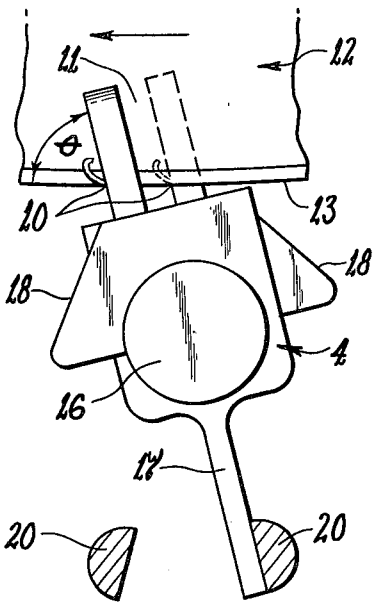
Figure 5:
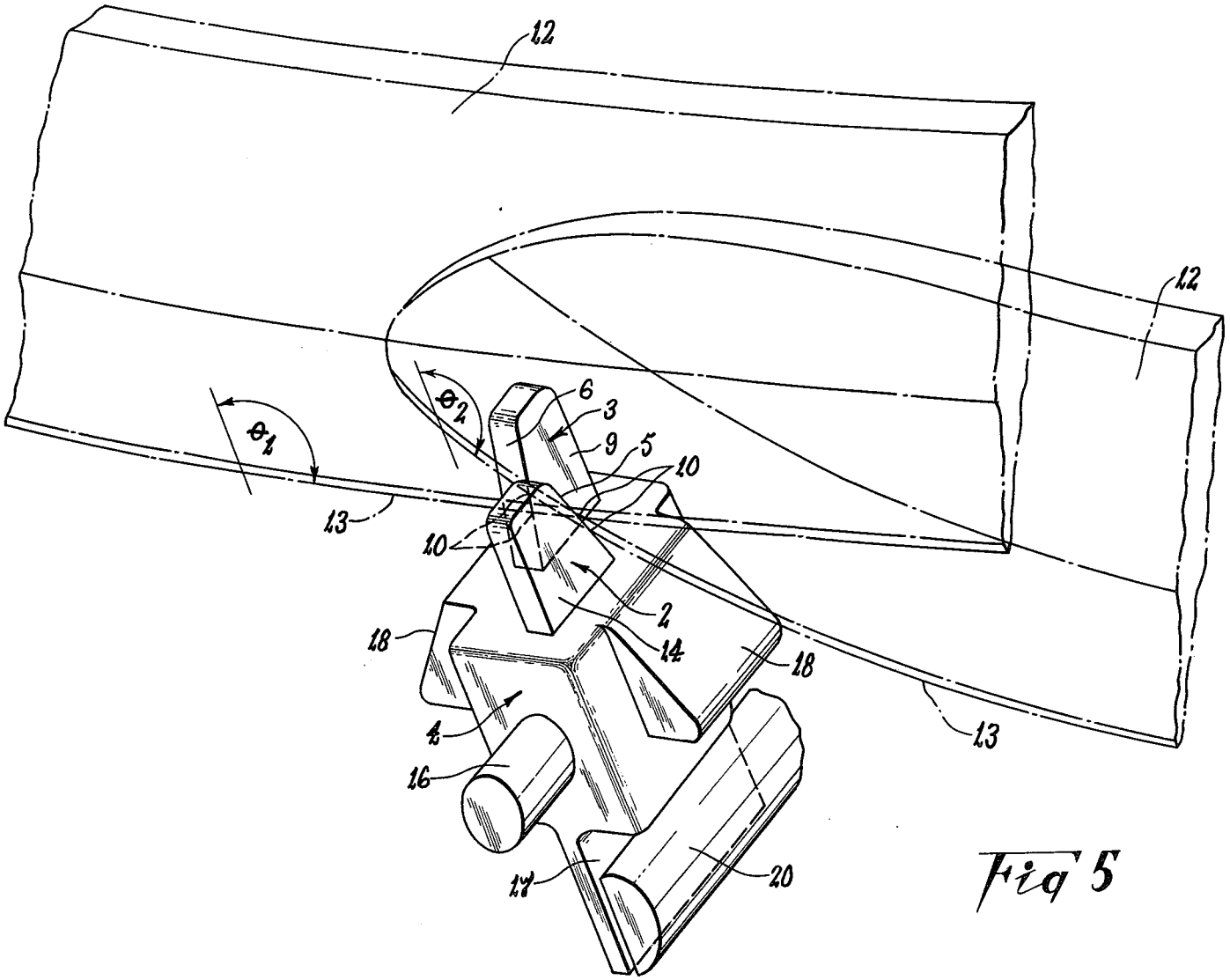
FIG. 5 is a perspective view showing the device engaged on the one hand by the tip section of a knife blade and on the other hand by a section of the blade spaced from the tip.

FIGS. 3 and 4 show the sharpening device in operation, and the angle $\theta$ shown in FIG. 3 is the "approach angle" previously referred to. FIG. 5 shows how the point of contact 10 between the knife blade 12 and sharpening edges 5 and 6 changes when the approach angle changes from $\theta_1$ to $\theta_2$. The last mentioned change results from variation in the contour of the blade cutting edge 13.

In a preferred form, each sharpening plate 2 and 3, or at least the parts of the broad surfaces thereof 9, 11, 14 and 15 which are exposed in use, are polished or otherwise treated to have a smooth finish. Experiments have revealed that a smooth surface has less affinity for fat and the like, than a rough surface. The level of that affinity decreases in direct proportion to the degree of smoothness of the surface. Satisfactory results have been achieved by polishing the plate surfaces 9, 11, 14 and 15, to a finish of 0.5 micro meters Ra value, but it is preferred to have a surface finish of 0.4 micro meters Ra value, or thereabouts.

The polishing operation can be carried out in any suitable manner, such as by rumbling in which the plates 2 and 3 are caused to tumble in a rotating barrel containing an abrasive medium such as silicon carbide paste. The edge surfaces 5 and 6 of the plates 2 and 3 which define boundaries of the sharpening recess 7 are preferably ground or otherwise treated to form sharp sharpening edges, subsequent to the polishing operation.

A device according to the invention is particularly useful in a scabbard of the general kind described in the previously mentioned Australian Pat. Nos. 424,122 and 447,537. The device shown in the accompanying drawings is suitable for that application in that the sharpening plates 2 and 3 are carried by a support block 4 moulded or otherwise formed from a plastics material, and having stub axles 16 to enable pivotal mounting as described in those patents. The support block 4 also has a cushioning spring 17 depending from its undersurface for engagement with stops 20, as also described in the aforementioned patents, but that is not essential. In addition, that part of the plates 2 and 3 defining the sharpening recess 7 stand proud above the support block 4 so as to minimize crevices which tend to accumulate debris, at least in the region of the sharpening edges 5 and 6.

If desired, a ramp surface 18 (FIGS. 3 to 5) may be provided on the support block 4, at least at the entrance side of the sharpening recess 7, so as to form a means for leading a knife blade 12 into the sharpening recess 7. It will generally be comvenient however, to provide a ramp surface 18 on both sides of the sharpening recess 7, as shown, especially if the support block 4 is moulded from a plastics material. The entrance side of the sharpening recess is that side facing the access opening of the scabbard when the device is used in a scabbard of the kind previously discussed.

The support block 4 need not be of the precise form described, and could be of a material other than a plastics material. For example, the support block 4 could be made from metal, and could be an integral part of each sharpener plate 2 and 3. The sharpener plates 2 and 3 could be made of any suitable material such as tungsten carbide.

Figure 6:
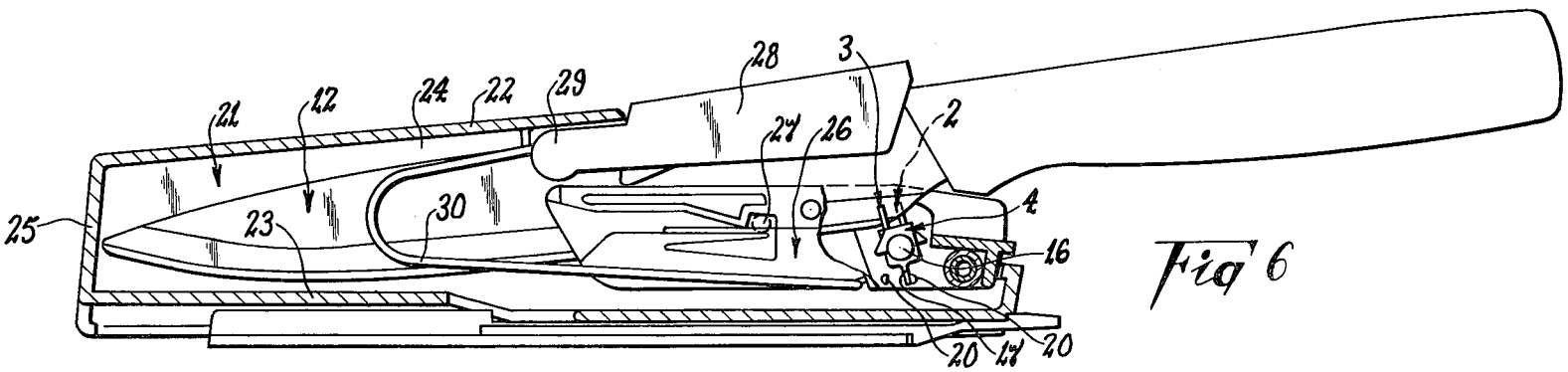
FIG. 6 is a longitudinal cross-sectional view of an example scabbard incorporating a sharpening device according to the invention.

An example scabbard incorporating a sharpening device according to the invention is shown in FIG. 6, but the device could be applied equally well to the scabbard of either Australian Pat. Nos. 424,122 and 447,537. In FIG. 6 example, the scabbard housing has a blade receiving passage 21 therein, which is defined between a top wall 22, base wall 23, and two side walls 24. One end of the passage 21 is closed by end wall 25, and an access opening is provided at the opposite end of the passage 21. The support block 4 of the sharpening device is pivotally mounted on a carrier 26 which is arranged for rocking movement about pivot 27. A reaction member 28, which is pivoted at 29, overlies the carrier 26, and a spring 30 urges the front end of the reaction member 28 and carrier 26 towards one another. Operation of the scabbard, and other aspects of its construction, are described in Australian Patent Application No. 20226/76.

It will be understood that various alterations, modifications, and/or additions may be incorporated into the foregoing without departing from the scope of the invention as defined by the appended claims.

Having now described my invention, what I claim as new and desire to secure by Letters Patent is:

1. A knife scabbard including; a housing having an elongate blade receiving passage formed therein and having an open front end, said passage having a longitudinal axis; a carrier member movably mounted within said passage adjacent said front end; a sharpening device having a support block pivotally mounted on said carrier member for relative movement about a pivot axis extending transverse to the longitudinal axis of said passage, and a pair of sharpening plates rigidly secured to said support block, said sharpening plates being relatively arranged so as to have respective broad surfaces in opposed and overlapping relationship to define a zone of overlap, and said broad surfaces being substantially parallel to said support block pivot axis; a sharpening recess defined between edges of said plates which extend beyond the zone of overlap and are relatively arranged such that a knife blade located in said recess and engaging said edges is sharpened when moved longitudinally in said passage in either direction relative to said plates; said opposed surfaces being spaced apart so that a gap exists between them at least along said edges for the full depth of said recess and an immediately adjacent part of said zone of overlap; and each said opposed surface is polished to have a degree of roughness not greater than 0.5 micro meters Ra value.

2. A knife scabbard according to claim 1, wherein the spacing of said surfaces is a distance substantially equal to the thickness of each of said plates.

3. A knife scabbard according to claim 1, wherein said support block has an upper surface facing said passage, said plates are secured to said support block so as to project beyond said upper surface thereof, and said block having a cushioning spring extending beyond an undersurface thereof.

4. A knife scabbard according to claim 3, wherein said support block has a ramp surface formed on each side of said sharpening recess.

5. A knife scabbard of claim 1, wherein said blade edges are defined by sloping ends disposed in parallel relation in plan.

* * * * *